US006276823B1

(12) United States Patent
King

(10) Patent No.: US 6,276,823 B1
(45) Date of Patent: Aug. 21, 2001

(54) METHOD FOR DESUPERHEATING STEAM

(75) Inventor: Leonard Tony King, Long Beach, CA (US)

(73) Assignee: Komax Systems, Inc., Wilmington, CA (US)

( * ) Notice: Subject to any disclaimer, the term of this patent is extended or adjusted under 35 U.S.C. 154(b) by 817 days.

(21) Appl. No.: 08/770,888

(22) Filed: Dec. 20, 1996

Related U.S. Application Data

(63) Continuation of application No. 08/565,591, filed on Nov. 30, 1995, now abandoned.

(51) Int. Cl.[7] ..... B01F 5/06
(52) U.S. Cl. ..... 366/181.5; 366/339
(58) Field of Search ..... 366/167.1, 173.1, 366/174.1, 175.2, 181.5, 336–340; 48/189.4; 138/37, 40, 42

(56) References Cited

U.S. PATENT DOCUMENTS 3,923,288 * 12/1975 King ..... 138/42 X
4,208,136 * 6/1980 King ..... 366/338
4,614,440 * 9/1986 King ..... 366/336
4,616,937 * 10/1986 King ..... 366/336
4,674,888 * 6/1987 Carlson ..... 366/337
4,753,535 * 6/1988 King ..... 366/337
4,808,007 * 2/1989 King ..... 366/174.1 X
5,066,137 * 11/1991 King ..... 138/42 X
5,176,448 * 1/1993 King et al. ..... 366/174.1

* cited by examiner

*Primary Examiner*—Charles E. Cooley
(74) *Attorney, Agent, or Firm*—Malcolm B. Wittenberg

(57) ABSTRACT

A desuperheater for reducing the superheated state of steam located within a cylindrically-shaped conduit. The desuperheater injects water droplets counter to the direction of moving superheated steam within the conduit. Downstream of the water droplet outlet is a biscuit which is aligned along the longitudinal axis of the conduit to provide a series of separate mixing elements all inducing the same rotational sign to fluids passing therethrough.

1 Claim, 1 Drawing Sheet

METHOD FOR DESUPERHEATING STEAM

Figure 1:
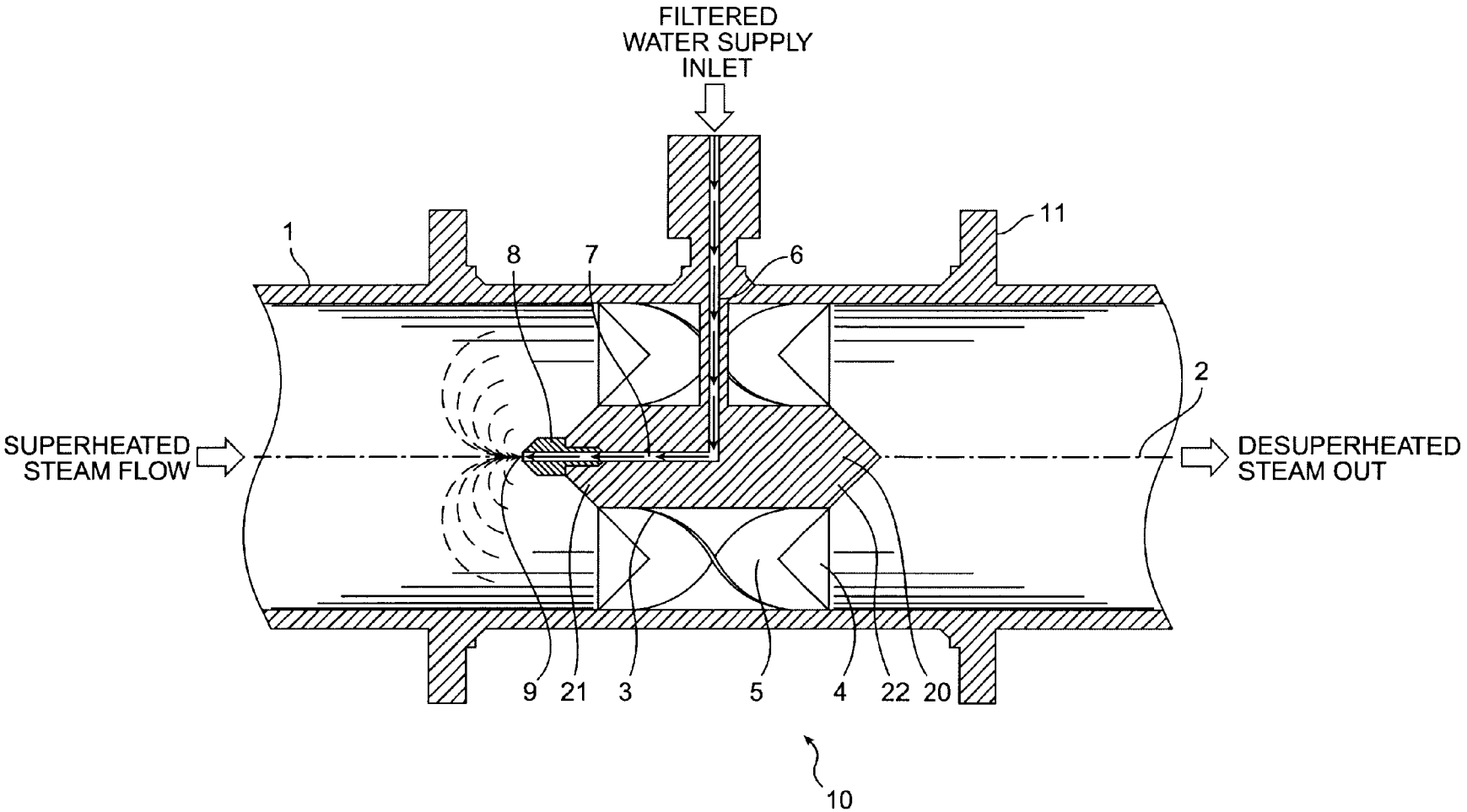

This is a continuation of application Ser. No. 08/565,591 filed Nov. 30, 1995 now abandoned entitled. "DESUPERHEATER".

TECHNICAL FIELD OF THE INVENTION

The present invention deals with a device known as a desuperheater. It has long been known that superheated steam is an excellent source of energy but for certain applications saturated steam or steam with only limited superheat is sought. As such, the present invention deals with an improved device for reducing the superheated state of steam to an acceptable value.

BACKGROUND OF THE INVENTION

When steam is manufactured from water, its temperature remains the same as that of the water. There is a specific relationship between steam temperature and pressure under saturation conditions. As such, saturated steam can only acquire energy by removing the steam from direct contact with water and by adding more heat to the body of steam as in a boiler superheater. As an example, steam might be generated at a temperature of 600° F. and a pressure of 300 psi which corresponds to about 190° of superheat. A typical application at the utilization point of the steam could be a tube and shell heat exchanger which works most efficiently if most of the steam superheat is removed before it enters the exchanger so that the steam may give up its heat of condensation. If not done, the steam will simply pass through the exchanger as a gas and very little heat transfer to the exchanger tubes will take place. In such an application, residual superheat of approximately 10° F. could be tolerated while other devices may tolerate higher degrees of superheat making precise temperature control easier.

A wide variety of desuperheater designs are available. Most of these cool or desuperheat steam by injecting a water spray into the steam pipe in the same direction as the steam flow. For example, Copes—Vulcan produces a number of desuperheating configurations. Perhaps the most straightforward design is a simple mechanical atomizing type desuperheater which consists of a main tube and spray nozzle. Cooling water flows through the main tube to the nozzle, which injects water droplets in the direction of steam flow in an attempt to achieve rapid absorption of the liquid water.

Another type of desuperheater consists of a steam atomizing device which includes a spray head having a series of nozzles arranged in a circle. Atomizing steam from a higher pressure source is introduced through the steam ports of the device at right angles to the radial cooling water holes thereby blasting each of the cooling water jets. The cooling water is projected at high velocity with small droplet size into the steam header where it is distributed and vaporized.

Yet another type of desuperheater is provided with a variable orifice consisting of a housing with self-regulating orifice. This orifice is made up of a circular seat with a flow plug maintained in concentric position by a plug guide. Cooling water enters the orifice chamber and is uniformly distributed around its periphery. The amount of water injected into the superheated steam is controlled by a diaphragm operated valve actuated by a temperature controller.

Generally, most prior art devices are situated in environments in which steam velocities are in the range of 30 to 300 feet per second. Nozzle spray patterns are often conical and nozzle water velocities must be high for two reasons. Firstly, one must avoid the steam momentum from collapsing the spray pattern into a central core. As such, nozzle exit velocity must be much higher than the steam velocity. Secondly, a high nozzle velocity must be maintained over the water flow rate range in order to produce small water droplets to give good contacting efficiency. As noted from the above discussion, as efficiencies improve, nozzle configurations become correspondingly more complex. Very high nozzle velocities lead to the need for stellite nozzle construction to minimize nozzle erosion. Pipe erosion can also be a problem and special linings have been employed to cope with such situations.

It is thus an object of the present invention to provide a device to improve the efficiency of desuperheaters regardless of the various environments in which such devices are located.

It is yet a further object of the present invention to provide an enhancement to desuperheaters in the form of a motionless mixing apparatus having no moving parts and is thus not complex nor subject to clogging or breakdown when used in severe environments.

These and further objects will be more readily appreciated when considering the following description and appended drawing in which:

The sole FIGURE shows the device of the present invention in cross-section.

SUMMARY OF THE INVENTION

A desuperheater for reducing the superheated state of steam located within a cylindrically-shaped conduit. The conduit is provided with a longitudinal axis and circular cross-section.

The desuperheater is provided for injecting water droplets within a directionally moving stream of superheated steam. The desuperheater comprises a biscuit which is aligned along the longitudinal axis, the biscuit possessing an upstream face and downstream face and a plurality of openings. Within the openings are located mixing elements which induce a rotational angular velocity to the superheated steam and water droplets passing therethrough. The desuperheater is further characterized such that all of the mixing elements induce the same rotational sign to the superheated steam and water droplets passing therethrough.

The biscuit supports the frustum of a cone emanating from its upstream face. The cone is aligned along the longitudinal axis. A feed leg radially emanates from the side wall of a conduit downstream of the frustum which is in fluid communication with a bore located within the biscuit along the longitudinal axis for discharge of a fluid stream of water droplets in a direction counter to the directionally moving superheated steam, the discharge of water droplets being from an opening located at the apex of said frustum.

DETAILED DESCRIPTION OF THE INVENTION

Turning to the sole FIGURE, desuperheater 10 is shown located within cylindrically shaped conduit 1. Alternatively, desuperheater 10 is provided with flanges 11 which can be used to attach to corresponding flanges of suitable conduit as an add-on processing element at any time desuperheating is required to reduce the superheated state of steam passing therethrough.

Conduit 1 is provided with longitudinal axis 2 as well as a circular cross-section. The desuperheater itself is provided for injecting water droplets in a direction opposite to the flow of superheated steam as shown in the FIGURE.

Desuperheater 10 comprises biscuit 20 possessing upstream face 21 and downstream face 22. The biscuit is also provided with a plurality of openings 4 where within said openings are located mixing elements 5 which induce a rotational angular velocity to the superheated steam and water droplets passing therethrough.

The FIGURE shows mixing element 5 as being in the shape of a helix inducing the same rotational angular velocity to superheated steam contained within conduit 1 and water droplets emanating from orifice outlet 9.

Downstream end 22 of biscuit 20 is generally of conical shape while upstream end 21 is in the shape of a frustum of a cone. Both the upstream and downstream ends of biscuit 20 are aligned with longitudinal axis 2. As noted from viewing the figure, nozzle 8, also in the general shape of a frustum of a cone, protrudes from upstream end 21, nozzle end 8 also being aligned with longitudinal axis 2.

As further noted from the FIGURE, feed leg 6 is shown radially emanating from the side wall of conduit 1 located downstream of upstream face 21 and nozzle 8. Through radial feed leg 6 is provided fluid, generally liquid water in communication with bore 7 located within said biscuit along longitudinal axis 2 for discharge of a fluid stream of water droplets in a direction counter to directionally moving superheated stream as shown in the FIGURE.

As an alternative to helical mixing elements 5, one could employ mixing elements such as those shown in applicant's U.S. Pat. Nos. 3,923,288 and 4,034,965, the disclosures of which are incorporated by reference. These mixing elements include a central flat portion, first and second ears, round or otherwise configured at their outside periphery for a general fit into openings 4 and which are bent upward and downward from the central flat portion. A second pair of ears at the opposite side of the flat portion are also provided again bent downward and upward respectively. Such elements may be formed from a single flat sheet by a punch press, for example.

Regardless of the specific mixing elements employed, it is imperative in practicing the present invention that all mixing elements induce the same rotational angular velocity to the superheated steam and water droplets passing therethrough. As such, when the superheated steam and water droplets pass along longitudinal axis 2 of conduit 1, they eventually are passed into contact with mixing elements 5 located within openings 4 which are preferably symmetrically spaced about longitudinal axis 2. Ideally, six such openings and corresponding mixing elements are provided in a typical application symmetrically spaced about longitudinal axis 2. When the fluids are passed in contact with mixing elements 5, a clockwise velocity vector or rotational vector is imposed if the mixing elements of U.S. Pat. Nos. 3,923,288 and 4,034,965 are employed, the flat portion of each mixing element transforms the rotational vector to a lateral or radial vector. Subsequent to the flat portion, the ear elements impose a further clockwise velocity vector adding somewhat to the lateral or radial vector. The ears also impose a substantially inward directed radial velocity vector on materials moving longitudinally whereas the remaining pair of ears impose a substantially outward directed radial velocity vector. When six equally sized and spaced openings 4 are provided, flow through conduit 1 is divided 12 ways and exits as six streams all violently rotating in the same direction. This produces six primary and many secondary impingement mixing zones at the exit of biscuit element 20 giving excellent contacting between the water droplets and the superheated steam.

It is noted that most conventional superheaters require a long length of pipe downstream to effect the proper mixing and contacting of steam and water which is testimony to their poor contacting efficiencies. By contrast, the desuperheater of the present invention requires only a short distance between the exit of biscuit 20 and a downstream temperature sensor.

Desuperheaters of the present invention have proven to be highly efficient while exhibiting rather low pressure drops. Specifically, the pressure drop of a desuperheater of the present invention is characterized by the following equation:

$$dP=8.32\times10^{-4}M^2/\text{psia}\ D^4\text{psi}$$

where:

$M$=steam flow rate in lb/hr.

psia=absolute operating pressure $D$=pipe inside diameter in inches

For example, for a steam pressure of 50 psig (65 psia), a steam flow rate of 3500 lb/hr and pipe size of 8 inches, the pressure drop across the present desuperheater would be only 0.03 psi.

Furthermore, the water flow rate requirements required for a given reduction of superheat compares favorably to desuperheaters of the prior art. Specifically, water flow rate requirements for the desuperheater of the present invention can be depicted by the following equation:

$$Q=0.002\ M_s(E_1-E_2)/(E_2-E_w)\text{gpm}$$

where:

$M_s$=steam flow rate in pounds per hour $E_1$=Enthalpy of superheated steam in BTU/pound $E_2$=Enthalpy of desuperheated steam $E_w$=Enthalpy of added water (wherein Enthalpy values can be taken from steam tables or from a Mollier diagram).

As an example of the water flow rate requirements of the present invention, given a steam flow rate of 25,000 lb/hr entering the present desuperheater at a pressure of 235 psig (250 psia) and at a temperature of 600° F., if the pressure drop through the desuperheater is 5 psi, the water flow rate required to produce an exit temperature of 410° F. would be:

$$Q=0.002\times25{,}000(1318.4-1208.3)/(1208.3-167.99)=5.29\ \text{gpm}$$

As further noted above, it is a design criteria that water droplets emanating from nozzle outlet 9 be directed upstream against the directional flow of superheated steam. As such, the axial velocity from the spray nozzle must stop and reverse. As such, the maximum velocity which water droplets can achieve is no greater than the surrounding superheated steam velocity.

In view of the foregoing, modifications to the disclosed embodiments within the spirit of the invention will be apparent to those of ordinary skill in the art. The scope of the invention is therefore to be limited only by the appended claims.

I claim:

1. A method for desuperheating steam having an initial amount of superheat located within a cylindrically-shaped conduit, said conduit having a longitudinal axis and circular cross-section, said desuperheater providing for injecting water droplets within a directionally moving stream of superheated steam, said desuperheater comprising a biscuit which is aligned along said longitudinal axis, said biscuit possessing an upstream face and downstream face and a plurality of openings where within said openings are located mixing elements which induce a rotational angular velocity to the superheated steam and water droplets passing therethrough, said desuperheater being further characterized such that all of said mixing elements induce the same rotational sign to said superheated steam and water droplets passing therethrough, said biscuit supporting a frustum of a cone emanating from the upstream face thereof and aligned along said longitudinal axis, a feed leg radially emanating from the side wall of said conduit downstream of said frustum which is in fluid communication with a bore located within said biscuit along said longitudinal axis thereof, said method further comprises passing a stream of water through said feed leg and bore located within said biscuit along said longitudinal axis thereof and discharging said stream of water through said bore in the form of water droplets in a direction counter to said directionally moving stream of superheated steam and passing said superheated steam and water droplets through said plurality of openings and mixing elements located therein whereupon said combination of water droplets and superheated steam are caused to assume a rotational angular velocity resulting in a dropping of the amount of superheat from said initial superheat amount.

* * * * *